US005823694A

United States Patent [19]

Ikegami

[11] Patent Number: 5,823,694

[45] Date of Patent: Oct. 20, 1998

[54] CUTTING DEVICE FOR CUTTING TAPE MATERIAL AND PRINTING APPARATUS INCORPORATING THE CUTTING DEVICE

[75] Inventor: Toshimasa Ikegami, Nagano, Japan

[73] Assignee: Seiko Epson Corporation, Tokyo, Japan

[21] Appl. No.: 773,640

[22] Filed: Nov. 8, 1996

[51] Int. Cl.[6] ..... B41J 11/06

[52] U.S. Cl. ..... 400/621; 400/593; 83/468.93

[58] Field of Search ..... 400/621, 593; 83/869, 468.8, 468.93

[56] References Cited

U.S. PATENT DOCUMENTS

| | | | |
|---|---|---|---|
| 4,227,305 | 10/1980 | Newman . | |
| 4,611,519 | 9/1986 | Hagerty | 83/468.93 |
| 4,976,573 | 12/1990 | Seki et al. | 83/869 |
| 5,216,961 | 6/1993 | Gray | 83/468.8 |
| 5,556,213 | 9/1996 | Kudo et al. | 400/621 |
| 5,599,119 | 2/1997 | Nonokawa et al. | 400/621 |
| 5,605,404 | 2/1997 | Nunokawa et al. | 400/621 |

*Primary Examiner*—John S. Hilten
*Attorney, Agent, or Firm*—Loeb & Loeb LLP

[57] ABSTRACT

There is provided a cutting device for cutting tape material. A tape-cutting block of the cutting device for cutting off the tape material has a pair of tape-cutting edges which slide past each other to thereby cut the tape material to a cut-off piece having a predetermined length. The tape-cutting block has at least one movable blade formed with one of the pair of tape-cutting edges. An end-trimming block of the cutting device for trimming an end of the cut-off piece has a pair of end-trimming edges which slide past each other to thereby trim the end of the cut-off piece into a predetermined shape. The end-trimming block has at least one movable blade formed with one of the pair of end-trimming edges. The at least one movable blade of the tape-cutting block and the at least one movable blade of the end-trimming block are caused to perform cutting operations by a single cutting operation component device. There is also provided a printing apparatus incorporating the cutting device.

30 Claims, 10 Drawing Sheets

CUTTING DEVICE FOR CUTTING TAPE MATERIAL AND PRINTING APPARATUS INCORPORATING THE CUTTING DEVICE

BACKGROUND OF THE INVENTION

1. Field of the Invention

This invention relates to a cutting device for cutting a printed portion of tape material to a predetermined length for use as a label and trimming each end of the resulting cut-off piece, e.g. into one with a radius, and a printing apparatus incorporating the cutting device.

2. Prior Art

As a conventional printing apparatus incorporating a cutting device of the above-mentioned kind, a tape-printing apparatus has been proposed e.g. by Japanese Laid-Open Patent Publication (Kokai) No. 3-278973, which includes a printing device for printing characters and figures on a printing tape affixed to a peel-off backing from which a printed portion can be removed, a tape feeder for advancing the printing tape to send the printed portion out of the apparatus, and a tape-cutting device for cutting the printed portion off the printing tape to a predetermined length. Further, this apparatus is equipped with an end-trimming device for trimming corners of opposite ends of the printed portion having the predetermined length into curved ones each having a predetermined radius. The trimming of the corners of the ends of the printed portion (cut-off piece) by the end-trimming device helps to prevent the printed portion, after it is affixed to an object or article as a label, from being peeled off at the ends thereof, and also enhance the appearance of the printed portion as a label. The tape-cutting device for cutting the printing tape to a predetermined length and the end-trimming device for trimming the ends of the printed portion (cut-off piece) are constructed as separate devices independent of each other, and operated independently of each other.

Thus, the conventional tape-printing apparatus includes two kinds of cutting devices for cutting the tape, i.e. the tape-cutting device and the end-trimming device, which are constructed separately and independently of each other. Therefore, it is necessary to provide the two cutting devices with respective drive mechanisms for driving the same, separately and independently of each other. As a result, much space has to be secured for the tape-cutting device, the drive mechanism for driving the tape-cutting device, the end-trimming device, and the drive mechanism for driving the end-trimming device, which poses a hurdle to reduction of the size of the tape-printing apparatus. Further, provision of the separate drive mechanisms independent of each other for the respective cutting devices is wasteful, and creates an obstacle to reduction of costs in manufacturing the conventional tape-printing apparatus.

SUMMARY OF THE INVENTION

It is a first object of the invention to provide a cutting device which has a block for cutting tape material to a predetermined length and a block for trimming ends of a cut-off piece of the tape material constructed such that they share as many component parts as possible, to thereby attain reduction of size and manufacturing costs.

It is a second object of the invention to provide a printing apparatus incorporating a cutting device which has a block for cutting tape material to a predetermined length and a block for trimming ends of a cut-off piece of the tape material constructed such that they share as many component parts as possible, to thereby attain reduction of size and manufacturing costs.

To attain the first object, according to a first aspect of the invention, there is provided a cutting device for cutting tape material, comprising tape-cutting means for cutting off the tape material, the tape-cutting means having a pair of tape-cutting edges which slide past each other to thereby cut the tape material to a cut-off piece having a predetermined length, the tape-cutting means having at least one movable blade formed with one of the pair of tape-cutting edges, end-trimming means for trimming an end of the cut-off piece, the end-trimming means having a pair of end-trimming edges which slide past each other to thereby trim the end of the cut-off piece into a predetermined shape, the end-trimming means having at least one movable blade formed with one of the pair of end-trimming edges, and cutting operation means provided as a single component for causing the at least one movable blade of the tape-cutting means and the at least one movable blade of the end-trimming means to perform cutting operations, respectively.

According to the first aspect of the cutting device of the invention, when the cutting operation means is operated, the tape-cutting means performs its cutting operation by sliding of the tape-cutting edges thereof past each other, and the end-trimming means performs its cutting operation by sliding of the end-trimming edges thereof past each other. In other words, by applying a force to one force-applying point (the cutting operation means) of the whole mechanism of the cutting device, cutting operations can be performed at two force-acting points (the cutting edges of the tape-cutting means and those of the end-trimming means) at the same time or sequentially. Therefore, it is possible to reduce the number of component parts of the cutting device, whereby the whole cutting device can be designed more compact and manufactured at reduced costs through the reduced number of component parts thereof.

In a preferred form, the cutting device includes a pair of bladed arms having intermediate portions, respectively, and a support shaft for connecting the intermediate portions of the pair of bladed arms with each other such that the bladed arms can perform relative rotation about the support shaft with respect to each other, thereby serving as a fulcrum of the pair of bladed arms when the pair of bladed arms perform the cutting operations, one of the pair of bladed arms being formed with one of the pair of tape-cutting edges at one half portion thereof on one side of the support shaft and one of the pair of end-trimming edges at another half portion thereof on another side of the support shaft, and another of the pair of bladed arms being formed with another of the pair of tape-cutting edges at one half portion thereof on the one side of the support shaft and another of the pair of end-trimming edges at another half portion thereof on the another side of the support shaft, whereby the pair of bladed arms form the tape-cutting means on the one side of the support shaft, and the end-trimming means on the another side of the support shaft, which operate on the fulcrum of the support shaft, the cutting operation means causing the relative rotation of the pair of bladed arms.

According to this preferred embodiment, when the cutting operation means is operated, the pair of bladed arms perform relative rotation with respect to each other, whereby the tape-cutting means and the end-trimming means perform respective cutting operations. The tape-cutting means is formed on the one half portions of the pair of bladed arms on the one side of the support shaft, and the end-trimming means on the other half portions of the pair of bladed arms on the other side of the support shaft, whereby the pair of bladed arms has a scissors-like cutter structure having two pairs of cutting blades on opposite sides of the support shaft. Therefore, the support shaft and the cutting operation means can be used in a shared manner for the two cutting blades. That is, the present cutting device has two force-acting points which correspond to one fulcrum and one force-applying point. As a result, the number of component parts of the cutting device can be reduced, and the whole cutting device can be designed compact and manufactured at reduced costs. Since the pair of bladed arms has a scissors-like cutter structure having two pairs of cutting blades on opposite sides of the support shaft, the amount of operations or required extent of motions of the tips of the scissors-like cutter structure can be reduced, which enables the whole cutting device to be designed compact.

Preferably, the cutting operation means has a spring for urging at least one of the pair of bladed arms so as to cause the relative rotation of the pair of bladed arms in a direction opposite to a direction of the cutting operations, and an operating mechanism for driving the at least one of the pair of bladed arms against an urging force of the spring acting in the direction opposite to the direction of the cutting operations so as to cause the relative rotation of the pair of bladed arms in the direction of the cutting operations.

According to this preferred embodiment, the cutting operation can be carried out by the force applied via the operating mechanism, and the non-cutting operation by the urging force of the spring. As a result, the construction of the cutting operation means can be simplified, and the cutting operation means can be operated with ease even when it is manually operated.

Further preferably, each of the bladed arms is bent such that the half portion on the one side of the support shaft and the another half portion on the another side of the support shaft form a predetermined angle about the support shaft.

According to this preferred embodiment, as the angle formed between the two half portions of each of the pair of bladed arms is the smaller, the tape-cutting means and the end-trimming means can be arranged at closer locations to each other, whereby the whole cutting device can be made even more compact in construction.

Further preferably, the angle formed about the support shaft between the one half portion on the one side of the support shaft extending in a direction away from the support shaft and the another half portion on the another side of the support shaft extending in another direction away from the support shaft is different between the pair of bladed arms.

According to this preferred embodiment, since the angle between the extending direction of the half portion on the one side of the support shaft and the extending direction of the half portion on the another side is different between the pair of bladed arms, the timing of cutting (sliding of the cutting edges past each other) is made different between the tape-cutting means and the end-trimming means. Therefore, cutting load is not increased or doubled even when a single operation of the cutting operation means of the cutting device causes the tape-cutting means to cut the tape material and the end-trimming means to trim the cut-off piece.

Further preferably, the one of the pair of tape-cutting edges and the one of the pair of end-trimming edges are formed on the one half portion on the one side and the another half portion on the another side of one of the pair of bladed arms, at respective sides identical to each other with respect to a direction of the relative rotation of the pair of bladed arms, the another of the pair of tape-cutting edges and the another of the pair of end-trimming edges being formed on the one half portion on the one side and the another half portion on the another side of the another of the pair of bladed arms, at respective sides opposite to the respective sides identical to each other with respect to the direction of the relative rotation of the pair of bladed arms.

According to this preferred embodiment, the two bladed arms are arranged across each other to form a scissors-like structure, so that the cutting operation by the tape-cutting means and the cutting operation by the end-trimming means are carried out sequentially, i.e. at different time points, by the same relative rotation of the bladed arms. As a result, during cutting of the cut-off piece by sliding of the cutting edges of the bladed arms past each other at one of the tape-cutting means and the end-trimming means, the cutting edges of the same at the other of the two blocks do not slide past each other, whereby the wear of the cutting edges of the bladed arms can be minimized, and unnecessary cutting load can be eliminated.

Alternatively, the one of the pair of tape-cutting edges and the one of the pair of end-trimming edges are formed on the one half portion on the one side and the another half portion on the another side of one of the pair of bladed arms, which is larger in the angle formed about the support shaft between the one half portion and the another half portion, on respective sides thereof facing inward with respect to the angle formed about the support shaft, while the another of the pair of tape-trimming edges and the another of the pair of end-trimming edges are formed on the one half portion on the one side and the another half portion on the another side of the another of the pair of bladed arms, which is smaller in the angle formed about the support shaft between the one half portion and the another half portion, on respective sides thereof facing outward with respect to the angle formed about the support shaft.

According to this alternative preferred embodiment, the two bladed arms are not arranged across each other (merely overlapped only at the support shaft), but forms a cutting tool similar to scissors in respect of sliding of the cutting edges past each other. Therefore, when the rotation of the bladed arms is in a direction of cutting by the tape-cutting means, for example, the same rotation of the bladed arms does not cause the end-trimming means to perform its cutting operation. Inversely, when the rotation of the bladed arms is in a direction of cutting by the end-trimming means, the same rotation of the bladed arms does not cause the tape-cutting means to perform its cutting operation. As a result, during sliding of the cutting edges of one of the tape-cutting means and the end-trimming means, the cutting edges of the other of the two blocks do not slide past each other, whereby the wear of the cutting edges of the bladed arms can be minimized, and unnecessary cutting load can be eliminated.

Further preferably, one of the pair of bladed arms, which is larger in the angle formed about the support shaft between the one half portion and the another half portion, is fixed.

According to this preferred embodiment, the working space required by the whole bladed arms can be minimized, and hence the cutting device can be designed compact.

Preferably, the another half portion of the one of the pair of bladed arms and the another half portion of the another of the pair of bladed arms forming the end-trimming means have a pair of blades in the form of a plate respectively extending in a direction toward each other to cooperatively perform cutting operation, the pair of end-trimming edges being formed on respective ends of the pair of blades facing toward each other.

According to this preferred embodiment, the blades extend in a direction perpendicular to a plane of rotation thereof such that they become closer to each other, and the pair of end-trimming edges are formed on ends of the blades facing toward each other, so that the blades have a cutting edge structure in which the end faces of the blades slide past each other. Therefore, the shape of the cutting edges of the blades, i.e. the profile or contour of the end faces of the blades define a shape to which the end of the cut-off piece is trimmed. The cutting edges of the blades can be easily formed according to a desired shape to which the end of the cut-off piece is trimmed.

Further preferably, the cutting device further includes a guide member for guiding the end of the cut-off piece of the tape material to set the cut-off piece in a cutting position where the pair of end-trimming edges slide past each other, and the guide member has a flat portion for guiding a selected one of a front surface and a reverse surface of the cut-off piece of the tape material, an end edge guide wall portion for guiding an end edge of the cut-off piece, and a side edge guide wall portion for guiding at least one side edge of the cut-off piece.

According to this preferred embodiment, the cut-off piece of the tape material is guided vertically by the flat portion, longitudinally by the end edge guide wall portion, and laterally by the side edge guide wall portion, to be brought to the cutting position of the pair of blades. Therefore, it is possible to accurately trim the end of the cut-off piece of the tape material to a desired shape.

Preferably, one of the ends of the respective pair of blades is formed with a protruding cutting edge portion protruding in the form of a circular segment, the one of the end-trimming edges being formed at the protruding cutting edge portion, another of the respective ends of the pair of blades being formed with a recessed cutting edge portion recessed in a form complementary to the form of the protruding cutting edge portion, the another of the pair of end-trimming edges being formed at the recessed cutting edge portion.

According to this preferred embodiment, it is possible to trim each corner of the cut-off piece of the tape material into one with a radius, or each end of the same to an arcuate shape. In trimming each corner of the cut-off piece into one with a radius, a uniform trimmed shape can be attained for each corner irrespective of variation in width of individual cut-off pieces. Further, since contours of the protruding cutting edge portion and the recessed cutting edge portion extend along a direction of cutting to form respective arcuate lines, the cutting edges on these portions of the blades are continuously brought into point-to-point contact with each other from a root side to a tip side of the bladed arms to carry out the cutting operation. This prevents the protruding cutting edge portion and the recessed cutting edge portion from being locked to each other.

In another preferred embodiment, the one of the respective ends of the pair of blades is formed with the protruding cutting edge portion formed by a pair of protruding cutting edge portions arranged at respective locations spaced from each other for trimming corners of one end of the cut-off piece of the tape material, the another of the respective ends of the pair of blades being formed with the recessed cutting edge portion formed by a pair of recessed cutting edge portions arranged at respective locations spaced from, each other in such a manner that the pair of recessed cutting edge portions are each recessed in a form complementary to a corresponding one of the pair of protruding cutting edge portions.

According to this preferred embodiment, the opposite corners of each end of the cut-off piece can be trimmed without inverting the cut-off piece upside down.

Further preferably, the cutting device further includes a guide member for guiding the cut-off piece of the tape material to a selected one of two cutting positions, where the pair of protruding cutting edge portions and the pair of recessed cutting edge portions respectively slide past each other, to thereby set a selected one of two corners of the end of the cut-off piece to the selected one of the two cutting positions, and the guide member has a flat portion for guiding one of a front surface and a reverse surface of the cut-off piece of the tape material, an end edge guide wall portion arranged at an intermediate location between the two cutting positions for guiding an end edge of the cut-off piece, and two side edge guide wall portions arranged outside the two cutting positions for each guiding a selected one of side edges of the cut-off piece corresponding thereto.

According to this preferred embodiment, the cut-off piece can be accurately set to each of the two cutting positions, and the flat portion and the end guide wall portions can be integrally formed such that they can be used in a shared manner for guiding the cut-off piece to the two cutting positions, permitting the two guide members to be made with ease. Further, since the end edge guide wall portion is arranged at an intermediate location between the two cutting positions, and the side edge guide wall portions are arranged outside the two cutting positions, after trimming one corner of one end of the cut-off piece at one of the two cutting positions, the resulting cut-off piece can be pivotally moved sideways with the one end of the cut-off piece in contact with the end edge guide wall portion, to thereby set an opposite corner of the one end of the cut-off piece to the other of the two cutting positions. Thus, a sequence of cutting operations can be carried out smoothly.

In another preferred form, the tape-cutting means comprises a fixed blade, and a movable blade, as the at least one movable blade thereof, for sliding on the fixed blade, the pair of tape-cutting edges being respectively formed on the fixed blade and the movable blade, the end-trimming means comprising a fixed blade, and a movable blade, as the at least one movable blade thereof, for sliding on the fixed blade of the end-trimming means, the pair of end-trimming edges being respectively formed on the fixed blade of the end-trimming means and the movable blade of the end-trimming means, the cutting device including a cutter body having the tape-cutting means formed on one half portion thereof, and the end-cutting block formed on another half portion thereof, the movable blade of the tape-cutting means and the movable blade of the end-trimming means being linked to the cutting operation means.

According to this preferred embodiment, when the cutting operation means is operated, the movable blades are rotated whereby the tape-cutting edges of the tape-cutting means and the end-trimming edges of the end-trimming means respectively slide past each other to perform respective cutting operations. The tape-cutting means is formed on the one half portion of the cutter body, and the end-trimming means on the other half portion of the same, whereby the two blocks perform their cutting operations through sliding of the cutting edges thereof past each other. Therefore, the cutting operation means can be used in a shared manner for the two pairs of cutting edges. That is, the cutting device of this embodiment has two force-acting points corresponding to a single force-applying point. As a result, the number of component parts of the cutting device can be reduced, and the whole device can be designed compact, and manufactured at reduced costs.

Further preferably, the cutter body is formed of a plate member having resilient properties, the fixed blade and the movable blade of the tape-cutting means being formed by portions of the one half portion of the plate member on respective opposite sides of a cut for the tape-cutting means, which is linearly formed from a peripheral end face of the one half portion of the plate member to an inner portion thereof, the pair of tape-cutting edges being formed on respective ends of the portions of the one half portion of the plate member on the opposite sides of the cut facing each other, the fixed blade and the movable blade of the end-trimming means being formed by portions of another half portion of the plate member on respective opposite sides of a cut for the end-trimming means, which is linearly formed from a peripheral end face of the another half portion of the plate member to an inner portion thereof, the pair of end-trimming edges being formed on respective ends of the portions of the another half portion of the plate member on respective opposite sides of the cut facing each other.

According to this preferred embodiment, the fixed blade and the movable blade of the tape-cutting means as well as the fixed blade and the movable blade of the end-trimming means can be integrally formed in a plate member having resilient properties. Therefore, a return spring implemented by the plate member can be commonly used, and further the cutter body can be manufactured by press-shaping or like processing with ease, so that it is possible to reduce overall costs of the whole cutting device.

In a further preferred form, the tape-cutting means comprises a fixed blade, and a movable blade, as the at least one movable blade thereof, for sliding on the fixed blade, the pair of tape-cutting edges being respectively formed on the fixed blade and the movable blade of the tape-cutting means, the end-trimming means comprising a fixed blade, and a movable blade, as the at least one movable blade thereof, for sliding on the fixed blade of the end-trimming means, the pair of end-trimming edges being respectively formed on the fixed blade and the movable blade of the end-trimming means, the cutting device including a cutter body formed with the fixed blade and the movable blade of one of the tape-cutting means and the end-trimming means, and the fixed blade of another of the tape-cutting means and the end-trimming means, the movable blade corresponding to the fixed blade of the another of the tape-cutting means and the end-trimming means being formed on the cutting operation means, the movable blade of the one of the tape-cutting means and the end-trimming means being linked to the cutting operation means.

According to this preferred embodiment, when the cutting operation means is operated, the movable blade of the cutter body is rotated, and at the same time the movable blade formed on the cutting operation means is rotated, whereby each pair of cutting edges of the tape-cutting means and the end-trimming means slide past each other to perform their cutting operations. In this case as well, the cutting operation means can be commonly used for causing the tape-cutting means and the end-trimming means to perform their cutting operations. That is, a single force-applying point corresponds to two force-acting points. Therefore, the number of component parts can be reduced, and the whole cutting device can be designed compact, and manufactured at reduced costs.

Preferably, the cutter body is formed of a plate member having resilient properties, the fixed blade and the movable blade of the end-trimming means being formed by portions of one half portion of the plate member on respective opposite sides of a cut for the end-trimming means, which is linearly formed from a peripheral end face of the one half portion of the plate member to an inner portion thereof, the pair of end-trimming edges being formed on respective ends of the portions of the one half portion of the plate member on the opposite sides of the cut facing each other.

According to this preferred embodiment, the fixed blade and the movable blade of the end-trimming means can be integrally formed in the plate member having resilient properties. Therefore, the end-trimming means can be formed by press-shaping or like processing with ease, and the manufacturing costs of the whole cutting device can be reduced.

To attain the second object, according to a second aspect of the invention, there is provided a printing apparatus, comprising cutting means for cutting tape material, the cutting means including tape-cutting means for cutting off the tape material, the tape-cutting means having a pair of tape-cutting edges which slide past each other to thereby cut the tape material to a cut-off piece having a predetermined length, end-trimming means for trimming an end of the cut-off piece, the end-trimming means having a pair of end-trimming edges which slide past each other to thereby trim the end of the cut-off piece into a predetermined shape, and cutting operation means provided as a single component for causing the tape-cutting means and the end-trimming means to perform cutting operations, respectively, printing means for printing a portion of the tape material as desired, and tape-feeding means for feeding the tape material to bring the tape material to the cutting means.

According to the printing apparatus of the second aspect of the invention, the cutting means can be designed compact, and can be manufactured at reduced costs, and accordingly, the printing apparatus can be reduced in size and manufacturing costs.

Preferably, the printing apparatus includes cutting operation-inhibiting means for inhibiting operation of the cutting operation means when the tape-feeding means is being in operation.

According to this preferred embodiment, it is possible to prevent the tape material from being cut before it is sent to a predetermined location of the cutting means. This is especially advantageous for manually-operated type of the cutting means.

The above and other objects, features, and advantages of the invention will become more apparent from the following detailed description taken in conjunction with the accompanying drawings.

DETAILED DESCRIPTION

The invention will now be described in detail with reference to the drawings showing embodiments thereof. In these embodiments, the invention is applied to a tape-printing apparatus which prints desired characters and figures on a printing tape and cuts off the printed portion of the printing tape to a predetermined length to obtain a separate piece of the printed portion in the form of a label (hereinafter referred to as "the cut-off piece"). The tape-printing apparatus also has a function of trimming corners of ends of the cut-off piece into ones with a radius.

Figure 1:
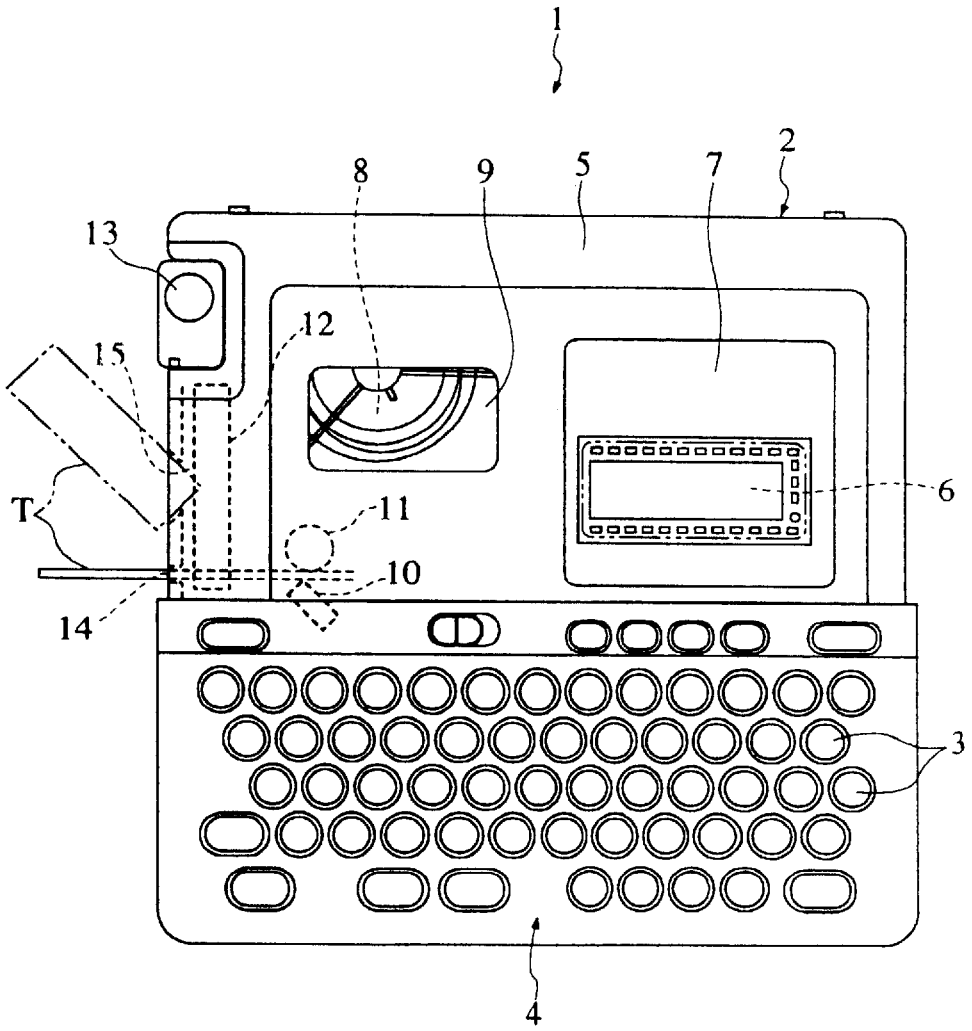
FIG. 1 is a plan view of a tape-printing apparatus according to a first embodiment of the invention.

Referring first to FIG. 1, there is shown the tape-printing apparatus 1 which is comprised of a body casing 2 housing various components therein, an input block 4 having a plurality of input keys 3, 3, 3, . . . , for inputting printing information to the apparatus, and a body cover 5 which can be opened and closed. Under the body cover 5, there is arranged a display block 6 for displaying a line or lines of characters input via the input block 4 and other information, which can be directly observed from the outside via a transparent window 7 formed in the body cover 5. Also, under the body cover 5, there is loaded a tape cartridge 8 containing a printing tape T. Whether the tape cartridge 8 is loaded can be confirmed by viewing the same via a confirmation window 9 formed in the body cover 5.

Further, under the body cover 5, there are arranged a print head 10 as printing means in the vicinity of the tape cartridge 8 loaded, and a platen roller 11 as tape-feeding means. The printing tape T is rolled out from the tape cartridge 8 by the platen roller 11, printed by the print head 10, and delivered from the apparatus. On the other hand, at a left-side portion of the body cover 5, there is provided a tape-cutting push button 13 for operating a cutter mechanism 12, referred to hereinafter. When the feeding of the printing tape T is stopped, the tape-cutting push button 13 is pushed or depressed, whereupon the printing tape T is cut to a predetermined length (printed portion+marginal white area).

The body casing 2 is formed with a tape delivery slit 14 via which the printing tape T is sent out of the apparatus, as well as a tape-inserting slit 15 for inserting the cut-off piece of the printing tape T into the apparatus for trimming the same. The cutter mechanism 12 is arranged within the body casing 2 in a manner facing the tape delivery slit 14 and the tape-inserting slit 15 (see FIGS. 1 and 2).

The tape-printing apparatus 1 is operated in the following manner: First, the body cover 5 is opened to load the tape cartridge 8 in the body casing 2, and then the body cover 5 is closed. Then, a power switch, not shown, which is arranged at a right-side portion of the body casing 2, is turned on, and characters to be printed are input from the input block 4. A line or lines of the input characters are converted to a line or lines of characters based on a different character code, as needed, and a predetermined key is operated to instruct the execution of printing. In response to the instruction, the print head 10 of a thermal transfer type prints the printing tape T with the line or lines of characters. As the printing proceeds, the printing tape T is advanced by the platen roller 11 until the printed portion of the printing tape T is sent out of the apparatus via the tape delivery slit 14. When the printing is complete, the feeding of the printing tape T is stopped. Then, the tape-cutting push button 13 is depressed to cut the printing tape T to a predetermined length, and the resulting cut-off piece is discharged from the tape delivery slit 14.

On the other hand, an end of the cut-off piece of the printing tape T is inserted into the apparatus according to the shape of the tape-inserting slit 15, and then the tape-cutting push button 13 is pushed to trim a corner of the end of the cut-off piece into one with a radius. The trimming is carried out for all four corners of the opposite ends of the cut-off piece of the printing tape T to obtain a label having round corners.

The printing tape T is a so-called peel-off paper-backed adhesive tape. The top of the printing tape is surface-treated for an excellent ink-spreading property, while the bottom of the same is coated with an adhesive and has a peel-off tape removably affixed thereto. When a portion of the peel-off tape affixed to the cut-off piece is peeled off or removed therefrom, the cut-off piece printed with characters and/or symbols can be affixed to a desired object as a label. There are provided several kinds of printing tape T, with various tape widths e.g. of 6 mm, 9 mm, 12 mm and 18 mm, for the tape-printing apparatus 1, as rolls each received within the tape cartridge 8.

Figure 2:
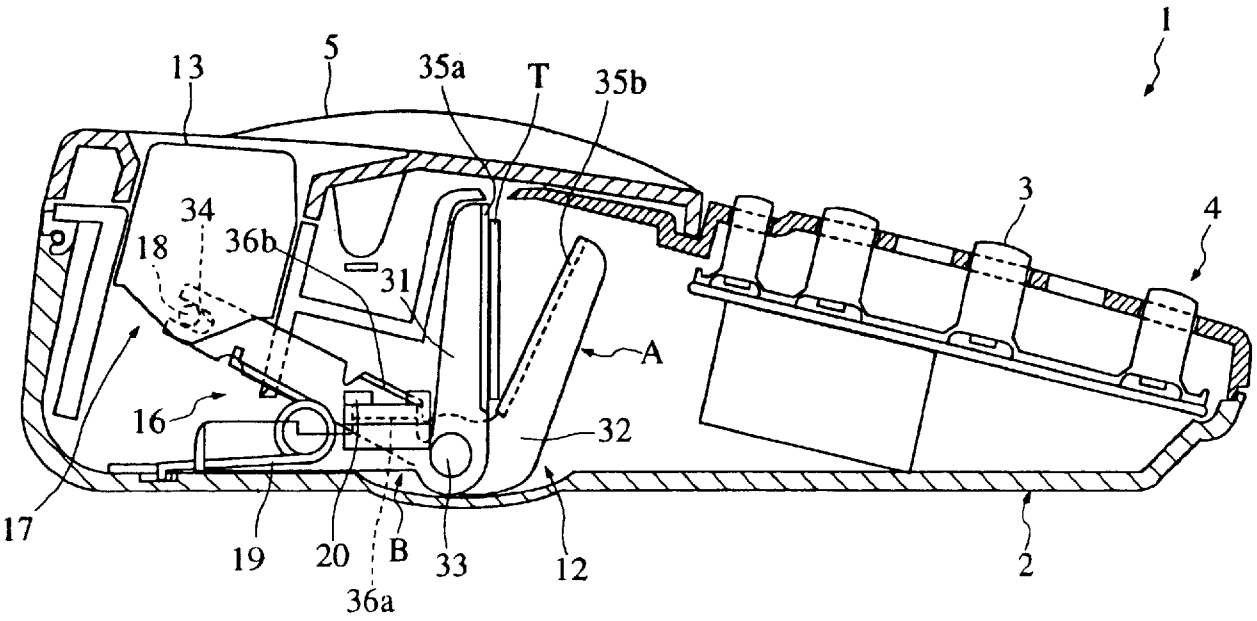
FIG. 2 is a sectional side view showing internal construction of the FIG. 1 tape-printing apparatus.

Next, the cutter mechanism 12 will be described in detail with reference to FIGS. 2 to 4. The cutter mechanism 12 is comprised of a tape-cutting block A for cutting the printing tape T to a predetermined length, and an end-trimming block B integrally formed with the tape-cutting block A for trimming the ends of the cut-off piece of the printing tape T. The tape-cutting block A faces the tape delivery slit 14 while the end-trimming block B faces the tape-inserting slit 15.

As shown in these figures, the cutter mechanism 12 includes a cutter body 16 which cuts by sliding of cutting edges thereof past each other, and bladed arm-rotating means 17 (cutting operation means) for actuating the cutter body 16 for cutting operation. The cutter body 16 is comprised of a pair of bladed arms 31, 32 each generally L-shaped, and a support shaft 33 rotatably supporting the bladed arms 31, 32 at respective intermediate bent portions thereof, in a manner associating the bladed arms 31, 32 to each other. Portions extending substantially perpendicularly upward from the respective bent portions form the tape-cutting block A, while portions extending substantially horizontally from the respective bent portions form the end-trimming block B. One bladed arm 31 is fixed to the body casing 2 and serves as a so-called fixed blade, while the other 32 is linked to the bladed arm-rotating means 17 and serves as a so-called movable blade.

The bladed arm-rotating means 17 is constituted by the tape-cutting push button 13, an engaging pin 18 projecting inward from a side wall of the tape-cutting push button 13, and a spring 19 for urging the bladed arm 32 as the movable blade in a rotational direction away from the printing tape T in the tape delivery slit 14. The tape-cutting push button 13 is mounted in the body casing 2 in a vertically slidable manner, and one end of the engaging pin 18 is engaged with an elongate recess 34 formed in an end of the bladed arm 32 at the end-trimming block B. On the other hand, the spring 19 is implemented by a torsion coiled spring or the like, with one end thereof attached to the body casing 2, and the other end attached to the bottom of the bladed arm 32 at the end-trimming block B. When the tape-cutting push button 13 is pushed downward, the bladed arm 32 is moved in a cutting rotational direction toward the printing tape T by the urging force applied via the engaging pin 18 so that the bladed arm 32 as the movable blade slides on the bladed arm 31 as the fixed blade at respective blocks such that the opposed cutting edges slide past each other to perform cutting operations. Then, when the tape-cutting push button 13 is released, the bladed arm 32 is rotated in the rotational direction opposite to the cutting rotational direction by the urging force of the spring 19, and the tape-cutting push button 13 returns to its standby position by the force applied via the engaging pin 18.

Half portions of the pair of bladed arms 31, 32 forming the tape-cutting block A are constructed in a manner similar to blades of ordinary scissors, and cutting edges 35*a*, 35*b* are formed on respective opposed portions of the bladed arms 31, 32. The cutting edge 35*a* of the bladed arm 31 at this block A faces a passageway of the printing tape T, i.e. the tape delivery slit 14, and a portion of the printing tape T guided into this passageway is caught by the cutting edge 35*b* of the bladed arm 32 as the movable blade and cut along the width of the tape from a lower side to an upper side as viewed from FIG. 3.

On the other hand, the other half portions of the pair of bladed arms 31, 32 constituting the end-trimming block B are formed with blades 36*a*, 36*b* such that the blades 36*a*, 36*b* extend from respective top portions of the other half portion of the bladed arms 31, 32 in a manner bent at right angles inward i.e. toward each other. That is, the blades 36*a* and 36*b* extend in respective inward directions perpendicular to a direction of rotation of the bladed arms 31, 32, with end faces 37*a*, 37*b* thereof being opposed to each other such that there is very little clearance therebetween when the blade 36*a* passes or slides on the blade 36*b*. At an intermediate portion of the blade 36*a* as the fixed blade, there is formed a protruding cutting edge portion 38*a* protruding in an arcuate form, and in a manner corresponding to the protruding cutting edge portion 38*a*, there is formed a recessed cutting edge portion 38*b* recessed in an arcuate form at an intermediate portion of the blade 36*b* as the movable blade. The protruding cutting edge portion 38*a* and the recessed cutting edge portion 38*b* are formed in a complementary manner to each other, and used in trimming the corners of ends of the cut-off piece of the printing tape T into ones with a radius. That is, the end faces 37*a*, 37*b* of the blades 36*a*, 36*b* are brought into contact with each other only at the protruding cutting edge portion 38*a* and the recessed cutting edge portion 38*b* for a cutting operation, whereby cutting load resulting from sliding of cutting edges of the blades 36*a*, 36*b* past each other is minimized.

Edges of the protruding cutting edge portion 38*a* and the recessed cutting edge portion 38*b*, i.e. the cutting edges of the blades 36*a*,36*b*, each extend along the direction of cutting to form a contour in the form of a circular segment with a central angle of approximately 90 degrees, so that the edges of the protruding cutting edge portion 38*a* and the recessed cutting edge portion 38*b* continuously slide past each other by point contact from the root side to the tip side of the end-trimming block B as the cutting process proceeds. This enables the blades 36*a*, 36*b* to perform trimming of the cut-off piece smoothly without being locked during cutting and non-cutting operations, even if the protruding cutting edge portion 38*a* and the recessed cutting edge portion 38*b* are protruded and recessed, respectively, in a direction perpendicular to the direction of cutting. The protruding cutting edge portion 38*a* and the recessed cutting edge portion 38*b* may have other shapes as viewed in plan view than the arcuate shapes of the present embodiment. Further, in FIG. 4, for easy understanding of construction of the blades, a certain gap is shown between the protruding cutting edge portion 38*a* and the recessed cutting edge portion 38*b*, but actually, as described above, there is no such a gap provided between them (the same applies to FIGS. 6 and 7).

The printing tape T is inserted via the tape-inserting slit 15 obliquely or in a skewed manner such that it is inclined through 45 degrees toward the blades 36*a*, 36*b*, (actually, the fixed blade 36*a*) constructed as above to set a selected corner of the cut-off piece to a position for cutting by the cutting edges of the end-trimming block B. To this end, the fixed blade 36*a* is provided with a guide member 20 for guiding the selected corner of the cut-off piece of the printing tape T to the position for cutting by the edges of the protruding cutting edge portion 38*a* and the recessed cutting edge portion 38*b*.

The guide member 20 is comprised of a flat portion 51 formed such that it has a top surface 51*a* flush with the top surface of the fixed blade 36*a*, as well as an end edge guide 52 and a side edge guide 53 formed on opposite sides of the flat portion 51 as a unitary member therewith. The flat portion 51 guides the reverse (or front) of the cut-off piece. When the cut-off piece is inserted horizontally via the tape-inserting slit 15, it is guided by the top surface 51*a* of the flat portion 51 to the protruding cutting edge portion 38*a* of the fixed blade 36*a* with a selected or inserted corner thereof held horizontally.

The end edge guide 52 and side edge guide 53 are formed symmetrical with respect to a center line of the protruding cutting edge portion 38*a*, with respective guide surfaces 52*a*, 53*a* opposed to each other forming an angle of 90 degrees. When the cut-off piece of the printing tape T is inserted via the tape-inserting slit 15, the guide surface 52*a* of the end edge guide 52 and the guide surface 53*a* of the side edge guide 53 guide one end edge and one side edge of the cut-off piece of the printing tape T, respectively. The cut-off piece introduced obliquely i.e. in a state inclined through 45 degrees is brought to a limit position set by the guide faces 52*a*, 53*a* where the selected corner of the cut-off piece of the printing tape T meets the edge of the protruding cutting edge portion 38*a* of the fixed blade 36*a* in a predetermined manner.

Thus, the cut-off piece of the printing tape T inserted from the tape-inserting slit 15 is guided vertically by the top face 51*a* of the flat surface 51, longitudinally by the guide surface 52*a* of the end edge guide 52, and laterally by the guide surface 53*a* of the side edge guide 53, whereby the selected corner of the cut-off piece is accurately guided to the protruding cutting edge portion 38*a*. Therefore, the mere insertion of the cut-off piece of the printing tape T via the tape-inserting slit 15 to its inner most position properly sets the cut-off piece for trimming the corner into a shape with a predetermined radius. In the present embodiment, irrespective of the width of the printing tape T used, after one corner of one end thereof is trimmed, the cut-off piece is inverted upside down to have the other corner trimmed, and then removed and turned around to have the other end thereof inserted to its innermost position, followed by trimming the corners of the other end of the cut-off piece in the same manner to complete trimming of the corners of the cut-off piece of the printing tape T.

Figure 3:
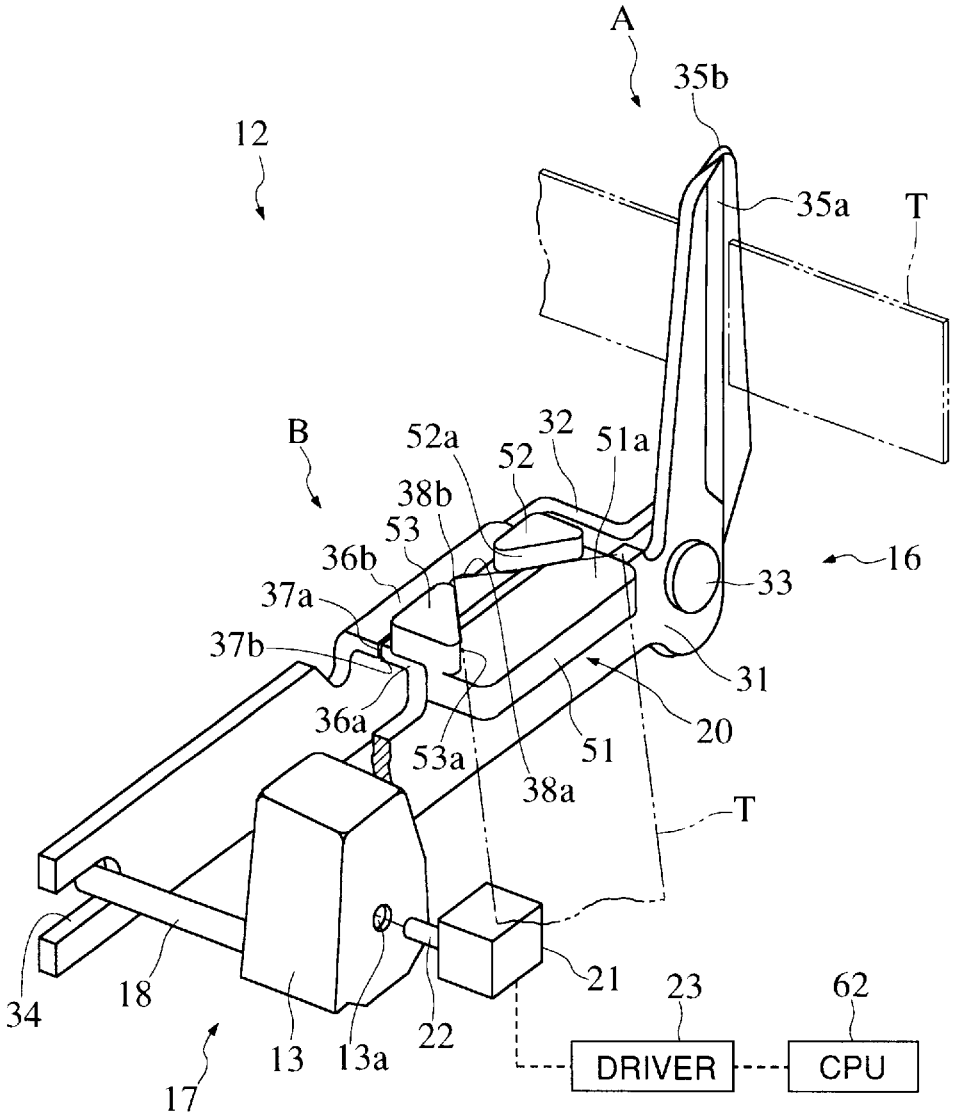
FIG. 3 is a perspective view of a cutter mechanism of the FIG. 1 tape-printing apparatus.
Figure 4:
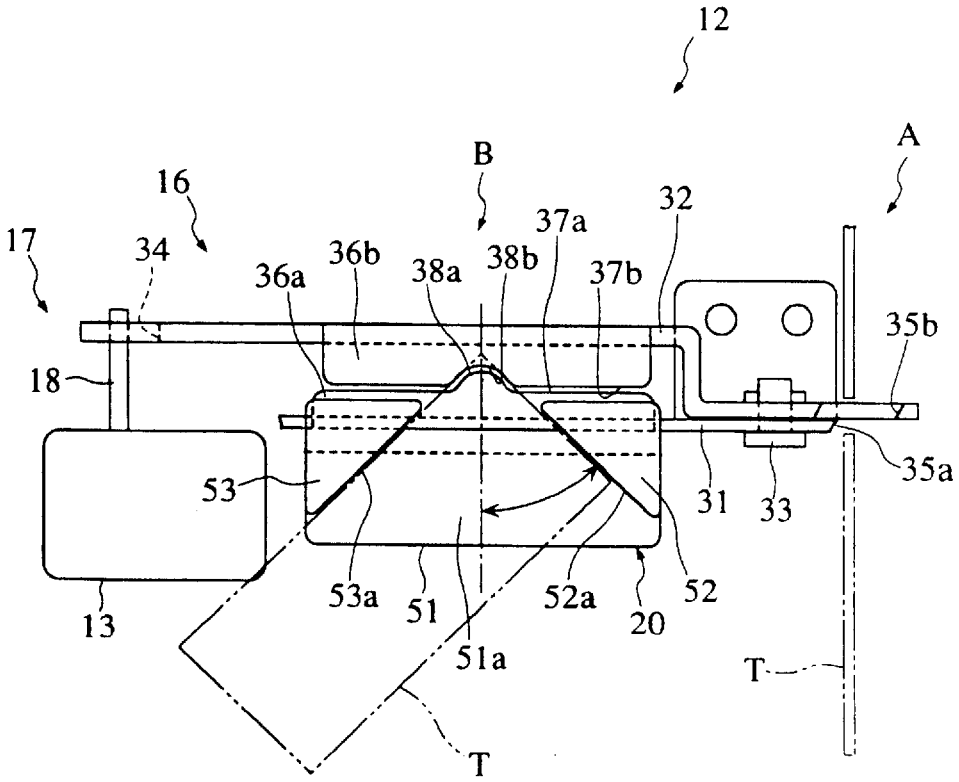
FIG. 4 is a plan view of an end-trimming block appearing in FIG. 3.

On the other hand, as shown in FIG. 3, a solenoid 21 is arranged in the vicinity of the tape-cutting push button 13, and a small hole 13*a* is formed in a side wall of the tape-cutting push button 13 for inserting a plunger 22 of the solenoid 21 therein. The plunger 22 of the solenoid 21 is inserted into the small hole 13*a* of the tape-cutting push button 13 in its standby position, whereby the depression of the tape-cutting push button 13 is inhibited. That is, when the solenoid 21 is energized to put the tip of the plunger 22 into the small hole 13*a*, the cutting operation of the cutter body 16 (cutter mechanism 12) is inhibited.

The solenoid 21 is connected to a driver 23, which in turn is connected to a CPU 62, referred to hereinafter. A driving signal delivered from the CPU 62 for driving the platen roller 11 is also supplied to the driver 23, whereby the CPU 62 causes the solenoid 21 to be energized via the driver 23. In short, the solenoid 21, the small hole 13*a*, the driver 23 and the CPU 62 form cutting operation-inhibiting means. Accordingly, when the platen roller 11 is being rotated to advance the printing tape T, the solenoid 21 is in an energized state to block the depression of the tape-cutting push button 13, whereas when the platen roller 11 stops to interrupt the advancing of the printing tape T, the solenoid 21 is in a deenergized state to permit the depression of the tape-cutting push button 13. Therefore, it is possible to effectively prevent the printing tape T from being erroneously cut when it is not in a predetermined cutting position.

Figure 5:
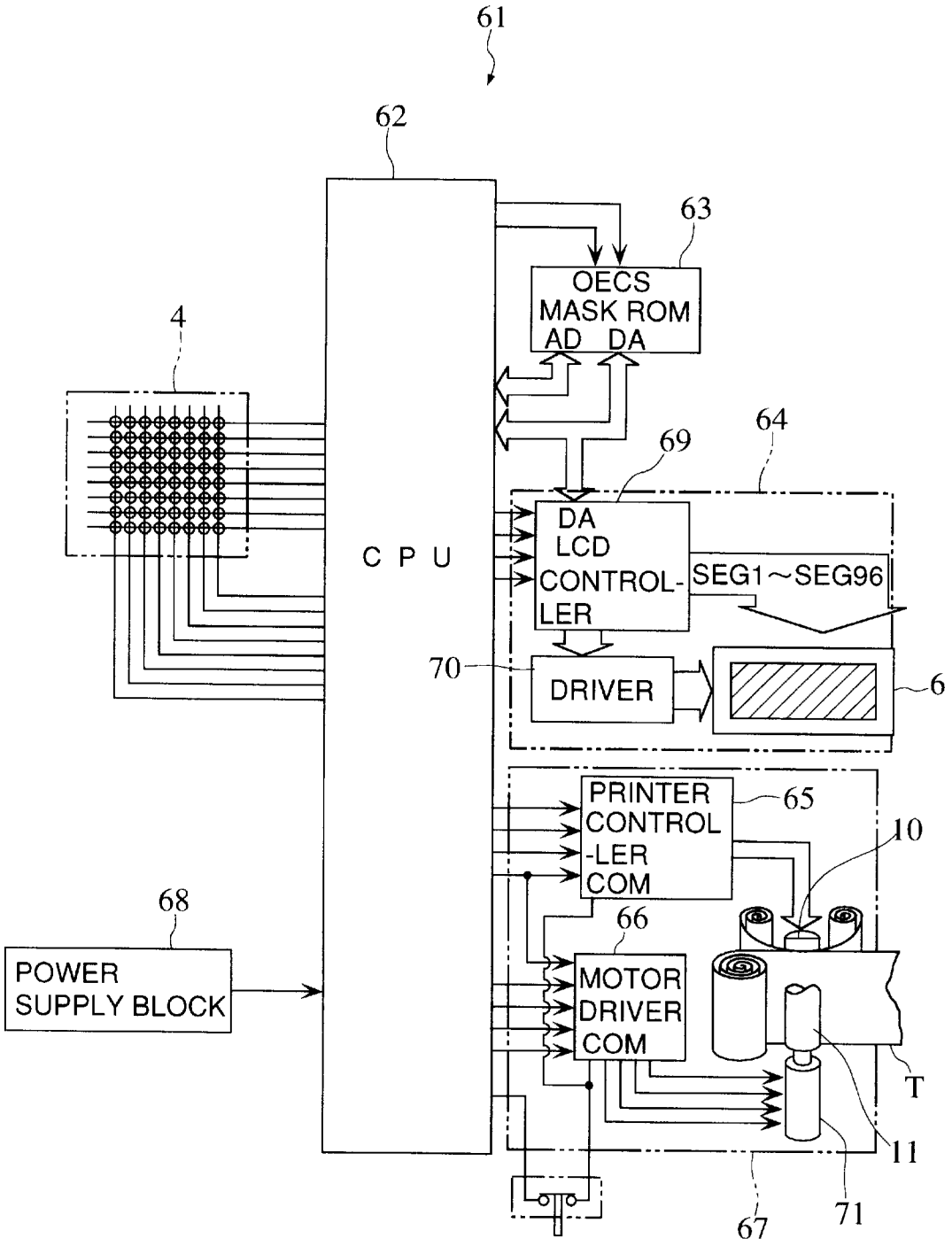
FIG. 5 is a block diagram of a control block of the tape-printing apparatus of the first embodiment.

Next, the electrical arrangement of the tape-printing apparatus 1 will be described with reference to FIG. 5, in which schematically shown is the configuration of a main circuit of the control block 61 for control of the overall operation of the tape-printing apparatus 1. As shown in the figure, the control block 61 includes the CPU 62 formed by one-chip microcomputer, a mask ROM 63, a display control circuit 64, a printer block 67 having a printer controller 65 and a motor driver 66, and a power supply block 68.

The CPU 62 incorporates a ROM, a RAM, and input/output ports. The ROM stores an operating program of the CPU 62, a font map, etc., therein. The RAM functions as a text area for editing text data, and at the same time, as a file area for temporarily storing the text data therein. Further, the CPU 62 is connected to the mask ROM 63, the display control circuit 64, the printer controller 65, the motor driver 66, and the input block 4 for control of all these devices.

The mask ROM 63 stores dot data of various kinds of symbols, such as characters and patterns, including ordinary print fonts, such as Mincho typeface and gothic typeface, special characters, such as mirrored characters, etc. The display control circuit 64 incorporates an LCD controller 69 and a driver 70, and controls the display of the display block 6 based on dot-matrix display data serially delivered from the CPU 62. The printer controller 65 controls the amount of electric current supplied to the print head 10 based on a print head control signal delivered from the CPU 62. The motor driver 66 drives a stepping motor 71 of the platen roller 11 which feeds the printing tape T and the ink ribbon based on a four-phased driving signal delivered from the CPU 62.

As described above, according to the tape-printing apparatus 1 of the present embodiment, the pair of bladed arms 31, 32, and the support shaft 33 connecting or associating these arms 31, 32 with each other constitute the tape-cutting block A which operates like scissors to cut the printing tape T, and the end-trimming block B which operates like scissors to trim the cut-off piece of the printing tape T, so that a fulcrum (support shaft 33) and a force-applying point (tape-cutting push button 13) can be used in a shared manner for two force-acting points (the cutting edges of the two cutting blocks A and B). Therefore, the cutter mechanism 12 can be made compact in construction and manufactured at reduced costs, so that the whole tape-printing apparatus 1 can be reduced in size and manufacturing costs as well. Further, since the pair of bladed arms 31, 32 are bent at the support shaft 33 into respective L shapes to form the tape-cutting block A and the end-trimming block B, this also contributes to reduction of the size of the apparatus.

Figure 6:
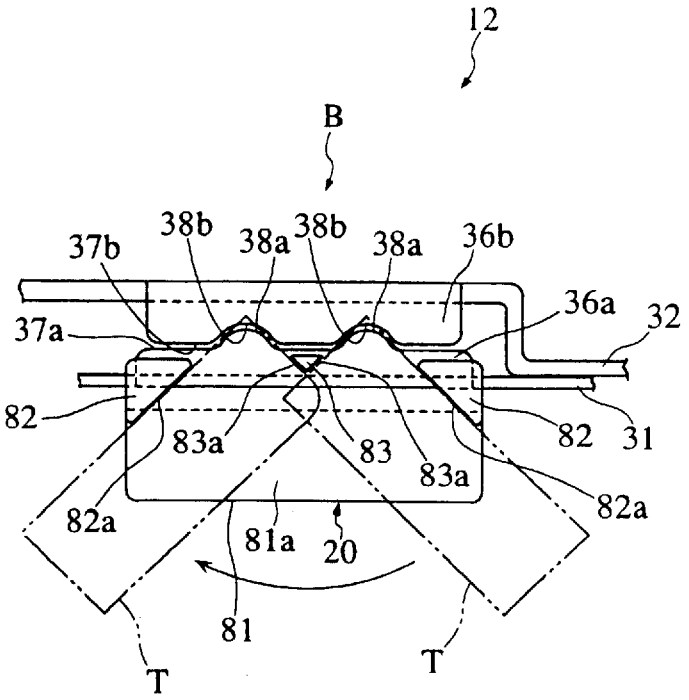
FIG. 6 is a plan view of a variation of the end-trimming block.

Next, a variation of the blades 36*a*, 36*b* of the end-trimming block B will be described with reference to FIG. 6. In this variation, two pairs of protruding cutting edge portions 38*a* and recessed cutting edge portions 38*b* are provided on the blades 36*a*, 36*b* such that the two pairs are spaced from each other by a predetermined distance. The guide member 20 is constructed such that it can be used in a shared manner for guiding the cut-off piece to the two pairs of the protruding cutting edge portions 38*a* and the recessed cutting edge portions 38*b*. That is, the guide member 20 is comprised of a flat portion 81 having a top surface 81*a* formed flush with the top face of the fixed blade 36*a*, a pair of side edge guides 82, 82 provided on opposite sides of the flat portion 81 in a manner integrally placed thereon, and an end edge guide arranged at an intermediate location between the pair of side edge guides 82, 82.

The pair of side edge guides 82, 82 are symmetrical with respect to a center line extending through a mid point between the protruding cutting edge portions 38*a*, 38*a*, and the guide surfaces 82*a*, 82*a* of the pair of side edge guides 82 opposed to each other, forming an angle of 90 degrees. The end edge guide 83 is arranged across the center line and has a pair of guide faces 83, 83 which are opposed to the guide faces 83*a*, 83*a* of the side edge guides 82, 82, forming an angle of 90 degrees. When the cut-off piece of the printing tape T is inserted obliquely via the tape-inserting slit 18 in a manner inclined through 45 degrees, one guide surface 83*a* of the end edge guide 83 and the guide surface 82*a* of one of the side edge guides 82 guide one corner of one end of the cut-off piece of the printing tape T until the one corner is properly set to one of the protruding cutting edge portions 38*a*. After trimming the one corner, the cut-off piece is rotated or moved sideways through 90 degrees with the one end thereof in contact with the end edge guide 83, and then inserted to the inner most position, whereupon the other guide surface 83*a* of the end edge guide 83 and the other guide surface 82*a* of the other side edge guide 82 guide the remaining corner of the one end of the cut-off piece until it properly meets the other protruding cutting edge portion 38*a*.

This construction of the variation of the present embodiment enables the corners of each end of the printing tape T to be trimmed without inverting the cut-off piece of the printing tape T upside down, whereby the trimming can be effected quickly in a simplified manner. The end edge guide 83 is not particularly limited to a triangular shape, but it may have a V-shape having two walls, or even a hollow or solid cylindrical shape.

Figure 7:
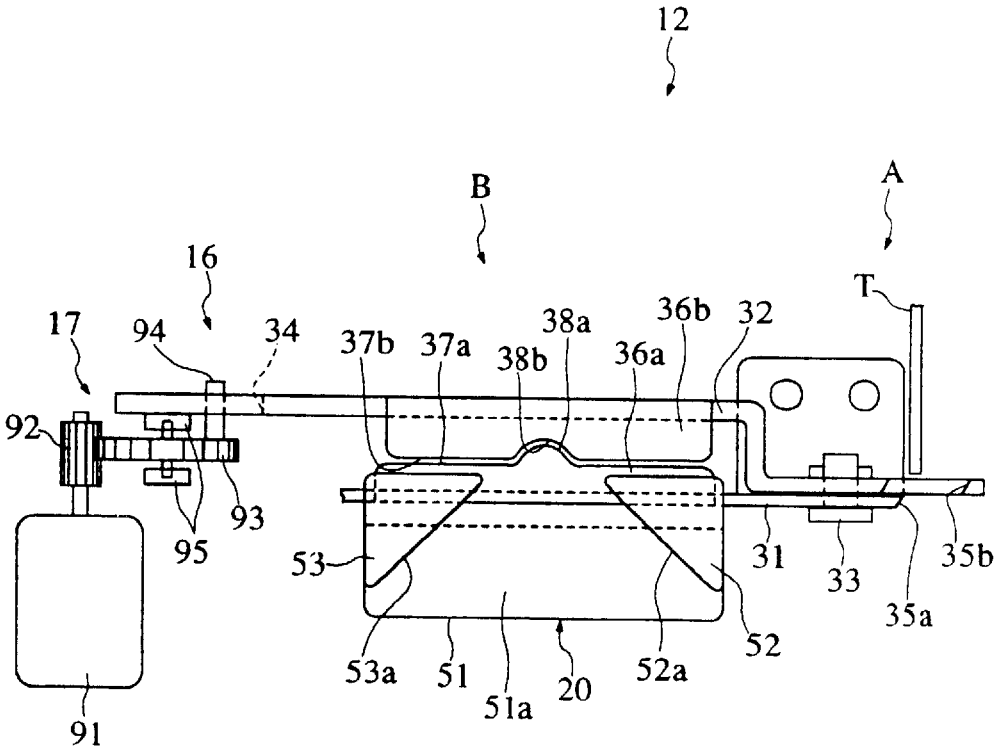
FIG. 7 is a plan view of a cutter mechanism employing a variation of bladed arm-rotating means of the tape-printing apparatus of the first embodiment.

Next, a variation of bladed arm-rotating means 17 will be described with reference to FIG. 7. In this variation, the cutting operation of the cutter body 16 can be automatically performed. The bladed arm-rotating means 17 is comprised of a motor 91 as a drive source, a crank gear wheel 93 mating with an output gear wheel 92 of the motor 91, and an engaging pin 94 fixed to the crank gear wheel 93 at an eccentric position. The engaging pin 94 engages with the elongate recess 34 formed in an end of the bladed arm 32 at the end-trimming block B. The crank gear wheel 93 is rotatably supported by a pair of bearings 95, 95, and is cooperatively associated with the engaging pin 94 to form a crank mechanism for swinging the bladed arm 32.

With rotation of the motor 91, when the crank gear wheel 93 rotates through a half turn, the bladed arm 32 is moved downward to perform a cutting operation, and when the crank gear wheel 93 rotates through another half turn, the bladed arm 32 is moved upward to perform a non-cutting operation. The driving of the motor 91 for the trimming may be carried out in response to a key-in of the input block 4, or alternatively, in response to detection of the insertion of the cut-off piece of the printing tape T by means of a switch or a sensor, not shown, arranged at the tape-inserting slit 15 or on the guide member 20.

Figure 8A:
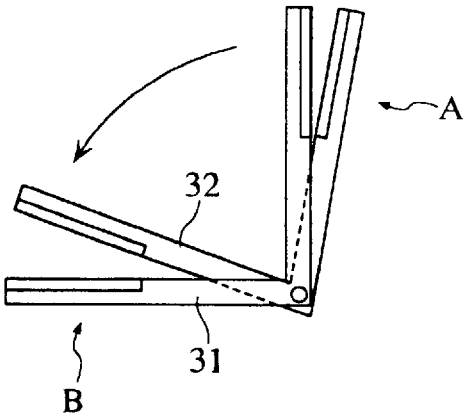
FIGS. 8A and 8B are schematic side views of variations of a cutter body of the tape-printing apparatus of the first embodiment.
Figure 8B:
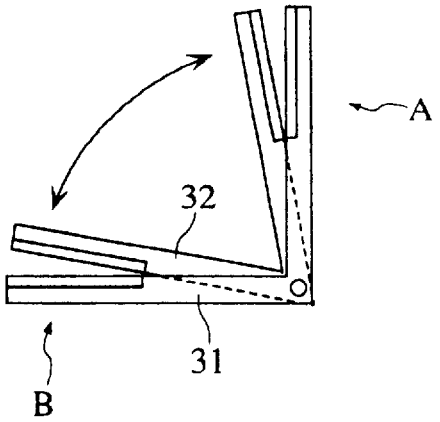

On the other hand, in the above embodiment, the fixed bladed arm 31 may be formed into an L shape bent at a right angle or an acute V shape, and the movable bladed arm 32 may be formed into a V shape more acute than the bladed arm 31. (The relationship of the fixed bladed arm 31 and the movable bladed arm 32 maybe reversed.) FIGS. 8A and 8B schematically show two types of arrangement of these blades arms: one in which the two bladed arms 31, 32 cross each other (FIG. 8A), and one in which they do not cross each other (FIG. 8B). In the case of FIG. 8A, as the movable bladed arm 32 rotates in one direction, first the tape-cutting block A performs its cutting operation, and then, as the same rotates further, the end-trimming block B performs its cutting operation. That is, the timing of sliding (cutting) of the cutting edges of the bladed arms 31, 32 is different between the tape-cutting block A and the end-trimming block B. Therefore, when the tape-cutting block A cuts the printing tape T, the cutting edges of the blade arms 31, 32 at the end-trimming block B do not slide past each other, which reduces load during the cutting operation.

In the case of FIG. 8B, as the movable bladed arm 32 rotates in one direction, one of the tape-cutting block A and the end-trimming block B performs its cutting operation, and as the same rotates in an opposite direction, the other performs its cutting operation. Therefore, load generated when the cutting edges of the bladed arms 31, 32 slide past each other can be reduced by half. Moreover, the movable bladed arm 32 can be rotated within a range of an inner angle formed by the half portions of the fixed bladed arm 31.

The above arrangement may be further developed such that the fixed bladed arm 31 has a V shape having an even more acute angle between the half portions thereof, and the half portions of the movable bladed arm 32 may be unitized into a double-edged blade. Inversely, the fixed bladed arm 31 and the movable bladed arm 32 may be connected in an X form. In this way, there can be various combinations of fixed blades and movable blades in different forms.

Figure 9:
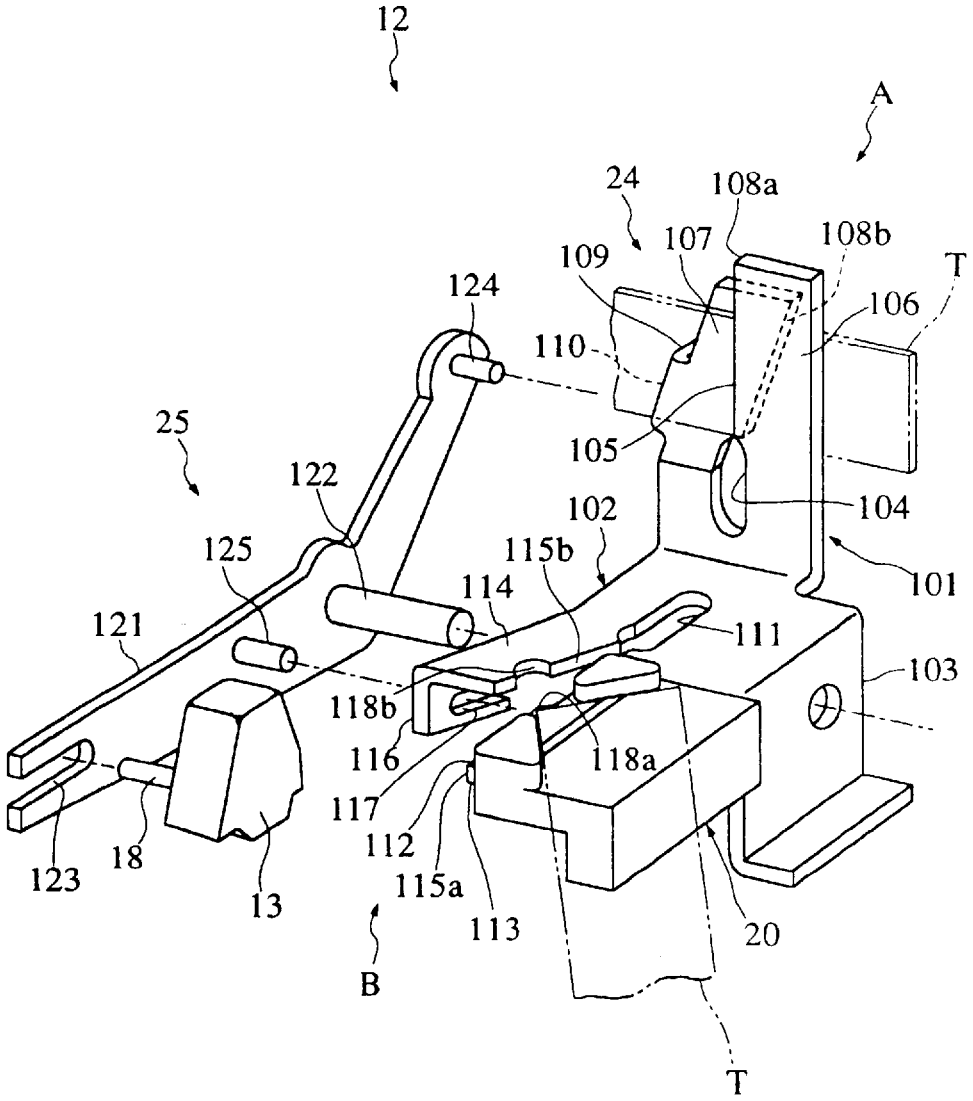
FIG. 9 is an exploded perspective view of a cutter mechanism of a tape-printing apparatus according to a second embodiment of the invention.

Next, a second embodiment of the invention will be described with reference to FIG. 9. This embodiment is distinguished from the first embodiment only in the construction of the cutter mechanism, and hence similar components are designated by identical reference numerals and detailed description thereof is omitted. The cutter mechanism 12 includes a cutter body 24 which is made by press-cutting and bending of a resilient steel plate to be integrally formed with a tape-cutting block A extending perpendicularly and an end-trimming block B extending horizontally, and cutting operation means 25 for causing the tape-cutting block A and the end-trimming block B to perform their cutting operations. Further, similarly to the first embodiment, the cutter mechanism of the present embodiment is provided with a guide member 20 (description of which is omitted).

The cutter body 24 is a unitary member having a horizontal portion 102 forming the end-trimming block B, a perpendicular portion 101 extending perpendicularly upward from one end of the horizontal portion 102 and forming the tape-cutting block A, and a leg 103 extending perpendicularly downward from one side of the horizontal portion 102 and fixed to the body casing 2 for supporting the horizontal portion 102 and the perpendicular portion 101. The perpendicular portion 101 has a cutout 104 formed in a central root portion thereof in the shape of an elongate slot, and a cut 105 extending upward from the cutout 104 to an end face of the perpendicular portion 101, whereby the perpendicular portion 101 is divided into a perpendicular fixed blade 106 and a perpendicular movable blade 107 on opposite sides (right and left sides as viewed in FIG. 9) of the cutout 104 and the cut 105. The perpendicular fixed blade 106 and the perpendicular movable blade 107 are formed with cutting edges 108*a*, 108*b* at respective portions corresponding to the cut 105, and the perpendicular movable blade 107 is opposed to the perpendicular fixed blade 106, which extends perpendicularly upward, such that the former is bent at a portion corresponding to the cutout 104. Further, a bent piece 109 extends from a side portion of the perpendicular movable blade 107, and the bent piece 109 is formed with an engaging recess 110 for engagement with the cutting operation means 25.

Similarly, the horizontal portion 102 has a cutout 111 formed in a root portion thereof, and a cut 112 which extends from the cutout 111 to an end face of the horizontal portion 102, whereby the horizontal portion 102 is divided into a horizontal fixed blade 113 and a horizontal movable blade 114 on opposite sides (right and left sides as viewed in FIG. 9) of the cutout 111 and the cut 112. The horizontal fixed blade 113 and the horizontal movable blade 114 have cutting edges 115*a*, 115*b* formed at respective portions corresponding to the cut 112, with the horizontal movable blade 114 being bent upward with respect to the horizontal fixed blade 113 extending horizontally. The horizontal movable blade 114 has a bent portion 116 which extends downward from a portion of the horizontal movable blade on a side opposite to the cutting edge 115*b*. The bent portion 116 is formed with an engaging recess 117 for engagement with the cutting operation means 25. Further, the horizontal fixed blade 113 and the horizontal movable blade 114 are respectively formed with a protruding cutting edge 118*a* and a recessed cutting edge 118*b*, similarly to the first embodiment. The horizontal fixed blade 113 has the guide member 20 attached thereto for guiding the cut-off piece of the printing tape T to the protruding cutting edge 118*a*.

The cutter body 24 having the above construction is actuated by the cutting operation means 25 in the following manner: At the tape-cutting block A, the perpendicular movable blade 107 swings such that it slides past the perpendicular fixed blade 106 to cut off the printing tape T, while at the end-trimming block B, the horizontal movable blade 114 swings such that it slides past the horizontal fixed blade 113 to trim the cut-off piece of the printing tape T. The perpendicular movable blade 107 and the horizontal movable blade 114 swing back in respective reverse directions by the resilient properties of root portions thereof having reduced widths resulting from the cutouts 104, 111, respectively, thereby causing the tape-cutting block A and the end-trimming block 2 to perform non-cutting operations.

The cutting operation means 25 is comprised of a tape-cutting push button 13, an engaging pin 18 projecting from a side wall of the tape-cutting push button 13, and a rotational lever 121 which is engaged with the engaging pin 18 at a tail end portion thereof for causing the perpendicular movable blade 107 and the horizontal movable blade 114 to perform respective cutting operations. The rotational lever 121 is bent upward at a substantially midpoint portion along its longitudinal axis to form a dogleg shape, and rotatably attached to the leg 103 of the cutter body 24 via a rotational shaft 122 provided at the substantially midpoint portion thereof. The rotational lever 121 is formed with an elongate recess 123 at the tail end portion thereof, with which the engaging pin 18 is engaged.

Further, the rotational lever 121 has a first pin 124 mounted at an opposite end to the tail end thereof, which engages with the engaging recess 110 formed in the horizontal movable blade 107. Similarly, the rotational lever 121 has a second pin 125 mounted at an intermediate portion between the rotational shaft 122 and the elongate recess 123, which engages with the engaging recess 117 of the horizontal movable blade 117. According to this arrangement, when the tape-cutting push button 13 is depressed, the rotational lever 121 rotates in an anticlockwise direction as viewed in the figure, whereby the perpendicular movable blade 107 and the horizontal movable blade 114 are respectively moved by the force transmitted via the first pin 124 and the second pin 125 for their cutting operations. Then, when the tape-cutting push button 13 is released, the perpendicular movable blade 107 and the horizontal movable blade 114 move in respective reverse or non-cutting directions by their own resilient properties so that the tape-cutting push button 13 returns to its stand-by position.

As described above, according to the cutter mechanism 12 of the second embodiment, one force-applying point can be used in a shared manner for two force-acting points. Therefore, the cutter mechanism 12 can be designed compact and manufactured at reduced costs. Further, the cutter body 24, which is formed by press-cutting and bending of a steel plate, can be made with ease at reduced costs.

Figure 10:
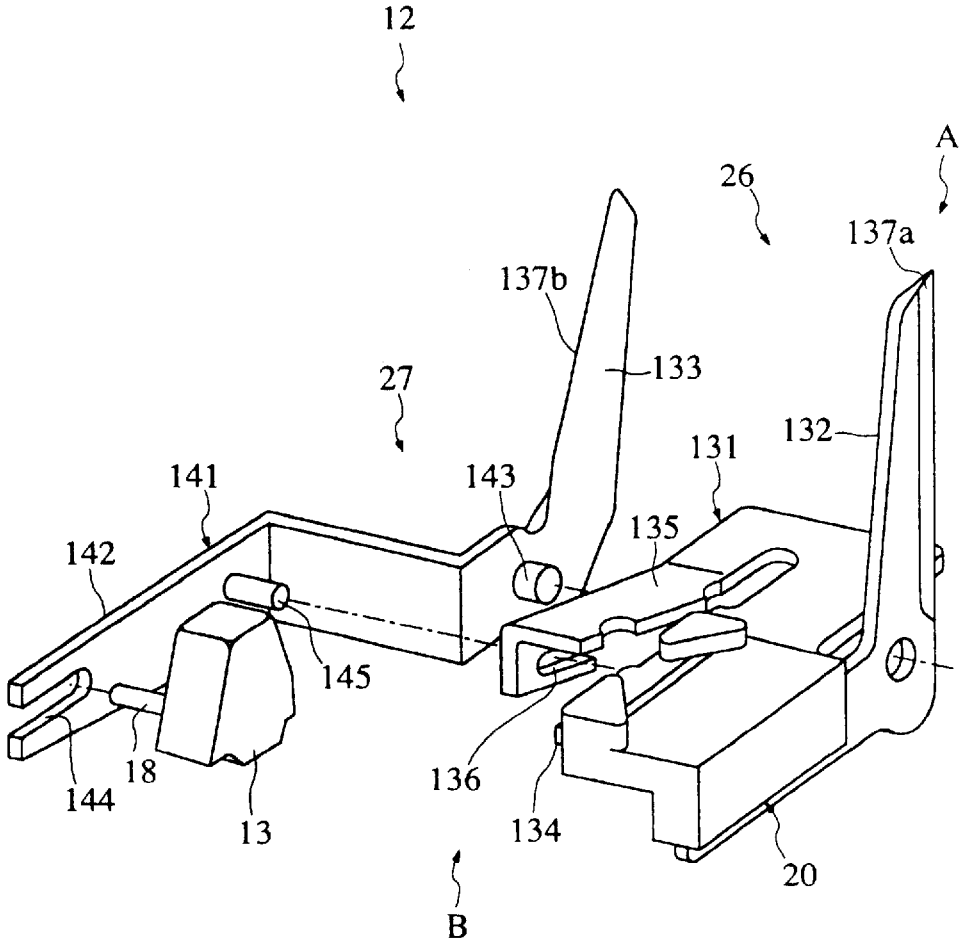
FIG. 10 is an exploded perspective view of a cutter mechanism of a tape-printing apparatus according to a third embodiment of the invention.

Next, a third embodiment of the invention will be described with reference to FIG. 10. This embodiment is distinguished only in the construction of the cutter mechanism 12 from the first and second embodiments. Therefore, similar components are designated by identical reference numerals and detailed description thereof is omitted. The cutter mechanism 12 of the present embodiment is comprised of a cutter body 26 having a horizontal portion 131 which is constructed similarly to the second embodiment to form the end-trimming block B, and a perpendicular fixed blade 132 in the form of an L shape, which forms one part of the tape-cutting block A, and cutting operation means 27 which is formed with a perpendicular movable blade 133, forming the other part of the tape-cutting block A, and at the same time operated to cause the end-trimming block B to perform its cutting operation. Further, the end-trimming block B is provided with a guide member 20 similar to that of the second embodiment, description of which is omitted.

The end-trimming block B is made by press-cutting and bending of a steel plate having resilient properties, similarly to the second embodiment, to be formed with a horizontal fixed bladed 134, a horizontal movable blade 135, an engaging recess 136, etc. The perpendicular fixed blade 132 is formed as a unitary member with the horizontal fixed blade 134 and continuously extends from a side portion of the horizontal fixed blade 134 in a manner bent upward. The perpendicular fixed blade 132 and the perpendicular movable blade 133 are respectively formed with cutting edges 137*a*, 137*b* and associated with each other to form scissors-like cutting means.

On the other hand, the cutting operation means 27 is comprised of a tape-cutting push button 13, an engaging pin 18 projecting from a side wall of the tape-cutting push button 13, and a rotational lever 141. The rotational lever 141 is comprised of a lever body 142 and the perpendicular movable blade 133 which extends from one end of the lever body 142 such that it is bent toward the perpendicular fixed blade 132, bent again in a direction parallel to the longitudinal axis of the lever body 142 and then extends upward. The perpendicular movable blade 133 has a support shaft 143 mounted at a lower portion thereof, and the rotational lever 141 including the perpendicular movable blade 133 is rotatably mounted by way of the support shaft 143 on a lower portion of the perpendicular fixed blade 132. That is, the perpendicular movable blade 133, the perpendicular fixed blade 132, and the support shaft 143 form the tape-cutting block A operating like scissors.

Further, the lever body 142 has an elongate recess 144 formed at a tail end thereof, with which an engaging pin 18 is engaged, and a second pin 145 formed at an intermediate portion of the lever body 142, which is engaged with an engaging recess 136 formed in the horizontal movable blade 135. According to this construction, when the tape-cutting push button 13 is depressed, the rotational lever 141 swings in an anticlockwise direction to cause the perpendicular movable blade 133 to slide on the perpendicular fixed blade 132 whereby the tape-cutting block A performs its cutting operation, and at the same time cause the horizontal movable blade 135 to be moved by the force transmitted via the second pin 145 to slide on the horizontal fixed blade 134 whereby the end-trimming block B performs its cutting operation. Thereafter, when the tape-cutting push button 13 is released, the perpendicular movable blade 133 and the horizontal movable blade 135 (linked to the rotational lever 141) swing in respective non-cutting directions to return the tape-cutting push button 13 to its standby position.

As described above, according to the cutter mechanism of the third embodiment, one force-applying point can be used in a shared manner for two force-acting points and two fulcrums. Therefore, the cutter mechanism 12 can be designed compact and manufactured at reduced costs. Further, the cutter body 26, which is formed by press-cutting and bending of a steel plate, can be made with ease at reduced costs.

It is further understood by those skilled in the art that the foregoing are preferred embodiments of the invention, and that various changes and modifications may be made without departing from the spirit and scope thereof.

What is claimed is:

1. A cutting device for cutting tape material, comprising:

tape-cutting means for cutting off said tape material, said tape-cutting means having a pair of tape-cutting edges which slide past each other to thereby cut said tape material to a cut-off piece having a predetermined length, said tape-cutting means having at least one movable blade formed with one of said pair of tape-cutting edges;

end-trimming means for trimming an end of said cut-off piece, said end-trimming means having a pair of end-trimming edges which slide past each other to thereby trim said end of said cut-off piece into a predetermined shape, said end-trimming means having at least one movable blade formed with one of said pair of end-trimming edges; and cutting operation means provided as a single component for causing said at least one movable blade of said tape-cutting means and said at least one movable blade of said end-trimming means to perform cutting operations, respectively.

2. A cutting device according to claim 1, including a pair of bladed arms having intermediate portions, respectively, and a support shaft for connecting said intermediate portions of said pair of bladed arms with each other such that said bladed arms can perform relative rotation about said support shaft with respect to each other, thereby serving as a fulcrum of said pair of bladed arms when said pair of bladed arms perform said cutting operations, one of said pair of bladed arms being formed with one of said pair of tape-cutting edges at one half portion thereof on one side of said support shaft and one of said pair of end-trimming edges at another half portion thereof on another side of said support shaft, and another of said pair of bladed arms being formed with another of said pair of tape-cutting edges at one half portion thereof on said one side of said support shaft and another of said pair of end-trimming edges at another half portion thereof on said another side of said support shaft, whereby said pair of bladed arms form said tape-cutting means on said one side of said support shaft, and said end-trimming means on said another side of said support shaft, which operate on said fulcrum of said support shaft, said cutting operation means causing said relative rotation of said pair of bladed arms.

3. A cutting device according to claim 2, wherein said cutting operation means has a spring for urging at least one of said pair of bladed arms so as to cause said relative rotation of said pair of bladed arms in a direction opposite to a direction of said cutting operations, and an operating mechanism for driving said at least one of said pair of bladed arms against an urging force of said spring acting in said direction opposite to said direction of said cutting operations so as to cause said relative rotation of said pair of bladed arms in said direction of said cutting operations.

4. A cutting device according to claim 2 or 3, wherein each of said bladed arms is bent such that said half portion on said one side of said support shaft and said another half portion on said another side of said support shaft form a predetermined angle about said support shaft.

5. A cutting device according to claim 4, wherein said angle formed about said support shaft between said one half portion on said one side of said support shaft extending in a direction away from said support shaft and said another half portion on said another side of said support shaft extending in another direction away from said support shaft is different between said pair of bladed arms.

6. A cutting device according to claim 5, wherein said one of said pair of tape-cutting edges and said one of said pair of end-trimming edges are formed on said one half portion on said one side and said another half portion on said another side of one of said pair of bladed arms, at respective sides identical to each other with respect to a direction of said relative rotation of said pair of bladed arms, said another of said pair of tape-cutting edges and said another of said pair of end-trimming edges being formed on said one half portion on said one side and said another half portion on said another side of said another of said pair of bladed arms, at respective sides opposite to said respective sides identical to each other with respect to said direction of said relative rotation of said pair of bladed arms.

7. A cutting device according to claim 6, wherein one of said pair of bladed arms, which is larger in said angle about said support shaft between said one half portion and said another half portion, is fixed.

8. A cutting device according to claim 5, wherein said one of said pair of tape-cutting edges and said one of said pair of end-trimming edges are formed on said one half portion on said one side and said another half portion on said another side of one of said pair of bladed arms, which is larger in said angle formed about said support shaft between said one half portion and said another half portion, on respective sides thereof facing inward with respect to said angle formed about said support shaft, while said another of said pair of tape-cutting edges and said another of said pair of end-trimming edges are respectively formed on said one half portion on said one side and said another half portion on said another side of said another of said pair of bladed arms, which is smaller in said angle formed about said support shaft between said one half portion and said another half portion, on respective sides thereof facing outward with respect to said angle formed about said support shaft.

9. A cutting device according to claim 8, wherein one of said pair of bladed arms, which is larger in said angle formed about said support shaft between said one half portion and said another half portion, is fixed.

10. A cutting device according to claim 2 or 3, wherein said another half portion of said one of said pair of bladed arms and said another half portion of said another of said pair of bladed arms forming said end-trimming means have a pair of blades in the form of a plate respectively extending in a direction toward each other to cooperatively perform cutting operation, said pair of end-trimming edges being formed on respective ends of said pair of blades facing forward each other.

11. A cutting device according to claim 10, further including a guide member for guiding said end of said cut-off piece of said tape material to set said cut-off piece in a cutting position where said pair of end-trimming edges slide past each other, and wherein said guide member has a flat portion for guiding a selected one of a front surface and a reverse surface of said cut-off piece of said tape material, an end edge guide wall portion for guiding an end edge of said cut-off piece, and a side edge guide wall portion for guiding at least one side edge of said cut-off piece.

12. A cutting device according to claim 11, wherein one of said respective ends of said pair of blades is formed with a protruding cutting edge portion protruding in the form of a circular segment, said one of said end-trimming edges being formed at said protruding cutting edge portion, another of said respective ends of said pair of blades being formed with a recessed cutting edge portion recessed in a form complementary to said form of said protruding cutting edge portion, said another of said pair of end-trimming edges being formed at said recessed cutting edge portion.

13. A cutting device according to claim 10, wherein one of said respective ends of said pair of blades is formed with a protruding cutting edge portion protruding in the form of a circular segment, said one of said end-trimming edges being formed at said protruding cutting edge portion, another of said respective ends of said pair of blades being formed with a recessed cutting edge portion recessed in a form complementary to said form of said protruding cutting edge portion, said another of said pair of end-trimming edges being formed at said recessed cutting edge portion.

14. A cutting device according to claim 10, wherein said one of said respective ends of said pair of blades is formed with said protruding cutting edge portion formed by a pair of protruding cutting edge portions arranged at respective locations spaced from each other for trimming corners of one end of said cut-off piece of said tape material, said another of said respective ends of said pair of blades being formed with said recessed cutting edge portion formed by a pair of recessed cutting edge portions arranged at respective locations spaced from each other in such a manner that said pair of recessed cutting edge portions are each recessed in a form complementary to a corresponding one of said pair of protruding cutting edge portions.

15. A cutting device according to claim 14, further including a guide member for guiding said cut-off piece of said tape material to a selected one of two cutting positions, where said pair of protruding cutting edge portions and said pair of recessed cutting edge portions respectively slide past each other, to thereby set a selected one of two corners of said end of said cut-off piece to said selected one of said two cutting positions, and wherein said guide member has a flat portion for guiding one of a front surface and a reverse surface of said cut-off piece of said tape material, an end edge guide wall portion arranged at an intermediate location between said two cutting positions for guiding an end edge of said cut-off piece, and two side edge guide wall portions arranged outside said two cutting positions for each guiding a selected one of side edges of said cut-off piece corresponding thereto.

16. A cutting device according to claim 1, wherein said tape-cutting means comprises a fixed blade, and a movable blade, as said at least one movable blade thereof, for sliding on said fixed blade, said pair of tape-cutting edges being respectively formed on said fixed blade and said movable blade, said end-trimming means comprising a fixed blade, and a movable blade, as said at least one movable blade thereof, for sliding on said fixed blade of said end-trimming means, said pair of end-trimming edges being respectively formed on said fixed blade of said end-trimming means and said movable blade of said end-trimming means, said cutting device including a cutter body having said tape-cutting means formed on one half portion thereof, and said end-trimming means formed on another half portion thereof, said movable blade of said tape-cutting means and said movable blade of said end-trimming means being linked to said cutting operation means.

17. A cutting device according to claim 16, wherein said cutter body is formed of a plate member having resilient properties, said fixed blade and said movable blade of said tape-cutting means being formed by portions of said one half portion of said plate member on respective opposite sides of a cut for said tape-cutting means, which is linearly formed from a peripheral end face of said one half portion of said plate member to an inner portion thereof, said pair of tape-cutting edges being formed on respective ends of said portions of said one half portion of said plate member on said opposite sides of said cut facing each other, said fixed blade and said movable blade of said end-trimming means being formed by respective portions of another half portion of said plate member on respective opposite sides of a cut for said end-trimming means, which is linearly formed from a peripheral end face of said another half portion of said plate member to an inner portion thereof, said pair of end-trimming edges being formed on respective ends of said portions of said another half portion of said plate member on respective opposite sides of said cut facing each other.

18. A cutting device according to claim 17, further including a guide member for guiding said end of said cut-off piece of said tape material to set said cut-off piece in a cutting position where said pair of end-trimming edges slide past each other, and wherein said guide member has a flat portion for guiding a selected one of a front surface and a reverse surface of said cut-off piece of said tape material, an end edge guide wall portion for guiding an end edge of said cut-off piece, and a side edge guide wall portion for guiding at least one side edge of said cut-off piece.

19. A cutting device according to claim 1, wherein said tape-cutting means comprises a fixed blade, and a movable blade, as said at least one movable blade thereof, for sliding on said fixed blade, said pair of tape-cutting edges being respectively formed on said fixed blade and said movable blade of said tape-cutting means, said end-trimming means comprising a fixed blade, and a movable blade, as said at least one movable blade thereof, for sliding on said fixed blade of said end-trimming means, said pair of end-trimming edges being respectively formed on said fixed blade and said movable blade of said end-trimming means, said cutting device including a cutter body formed with said fixed blade and said movable blade of one of said tape-cutting means and said end-trimming means, and said fixed blade of another of said tape-cutting means and said end-trimming means, said movable blade corresponding to said fixed blade of said another of said tape-cutting means and said end-trimming means being formed on said cutting operation means, said movable blade of said one of said tape-cutting means and said end-trimming means being linked to said cutting operation means.

20. A cutting device according to claim 19, wherein said cutter body is formed of a plate member having resilient properties, said fixed blade and said movable blade of said end-trimming means being formed by portions of one half portion of said plate member on respective opposite sides of a cut for said end-trimming means, which is linearly formed from a peripheral end face of said one half portion of said plate member to an inner portion thereof, said pair of end-trimming edges being formed on respective ends of said portions of said one half portion of said plate member on said opposite sides of said cut facing each other.

21. A cutting device according to claim 20, further including a guide member for guiding said end of said cut-off piece of said tape material to set said cut-off piece in a cutting position where said pair of end-trimming edges slide past each other, and wherein said guide member has a flat portion for guiding a selected one of a front surface and a reverse surface of said cut-off piece of said tape material, an end edge guide wall portion for guiding an end edge of said cut-off piece, and a side edge guide wall portion for guiding at least one side edge of said cut-off piece.

22. A printing apparatus, comprising:

cutting means for cutting a tape material, said cutting means including tape-cutting means for cutting off tape material, said tape-cutting means having a pair of tape-cutting edges which slide past each other to thereby cut said tape material to a cut-off piece having a predetermined length, end-trimming means for trimming an end of said cut-off piece, said end-trimming means having a pair of end-trimming edges which slide past each other to thereby trim said end of said cut-off piece into a predetermined shape, and cutting operation means provided as a single component for causing said tape-cutting means and said end-trimming means to perform cutting operations, respectively;

printing means for printing a portion of said tape material as desired; and tape-feeding means for feeding said tape material to bring said tape material to said cutting means.

23. A printing apparatus according to claim 22, wherein said cutting means includes a pair of bladed arms having intermediate portions, respectively, and a support shaft for connecting said intermediate portions of said pair of bladed arms with each other such that said bladed arms can perform relative rotation about said support shaft with respect to each other, thereby serving as a fulcrum of said pair of bladed arms when said pair of bladed arms perform said cutting operations, one of said pair of bladed arms being formed with one of said pair of tape-cutting edges at one half portion thereof on one side of said support shaft, and one of said pair of end-trimming edges at another half portion thereof on another side of said support shaft, and another of said pair of bladed arms being formed with another of said pair of tape-cutting edges at one half portion thereof on said one side of said support shaft, and another of said pair of end-trimming edges at another half portion thereof on said another side of said support shaft, whereby said pair of bladed arms form said tape-cutting means on said one side of said support shaft, and said end-trimming means on said another side of said support shaft; which operate on said fulcrum of said support shaft, said cutting operation means causing relative rotation of said pair of bladed arms.

24. A printing apparatus according to claim 23, wherein said tape-cutting means comprises a fixed blade, and a movable blade for sliding on said fixed blade, said pair of tape-cutting edges being respectively formed on said fixed blade and said movable blade, said end-trimming means comprising a fixed blade, and a movable blade for sliding on said fixed blade of said end-trimming means, said pair of end-trimming edges being respectively formed on said fixed blade of said end-trimming means and said movable blade of said end-trimming means, said cutting means including a cutter body having said tape-cutting means formed on one half portion thereof, and said end-trimming means formed on another half portion thereof, said movable blade of said tape-cutting means and said movable blade of said end-trimming means being linked to said cutting operation means.

25. A printing apparatus according to claim 23, wherein said tape-cutting means comprises a fixed blade, and a movable blade for sliding on said fixed blade, said pair of tape-cutting edges being respectively formed on said fixed blade and said movable blade of said tape-cutting means, said end-trimming means comprising a fixed blade, and a movable blade for sliding on said fixed blade of said end-trimming means, said pair of end-trimming edges being respectively formed on said fixed blade and said movable blade of said end-trimming means, said cutting means including a cutter body formed with said fixed blade and said movable blade of one of said tape-cutting means and said end-trimming means, and said fixed blade of another of said tape-cutting means and said end-trimming means, said movable blade corresponding to said fixed blade of said another of said tape-cutting means and said end-trimming means being formed on said cutting operation means, said movable blade of said one of said tape-cutting means and said end-trimming means being linked to said cutting operation means.

26. A printing apparatus according to any one of claims 22 to 25, including cutting operation-inhibiting means for inhibiting operation of said cutting operation means when said tape-feeding means is being in operation.

27. A printing apparatus according to claim 26, wherein said cutting means further includes a guide member for guiding said end of said cut-off piece of said tape material to set said cut-off piece in a cutting position where said pair of end-trimming edges slide past each other, and wherein said guide member has a flat portion for guiding a selected one of a front surface and a reverse surface of said cut-off piece of said tape material, an end edge guide wall portion for guiding an end edge of said cut-off piece, and a side edge guide wall portion for guiding at least one side edge of said cut-off piece.

28. A method of shaping tape member, comprising the steps of:

operating cutting operation means as a single component;

causing tape-cutting means and a tape-trimming block to operate in a manner linked to operation of said cutting operation means;

causing a pair of tape-cutting edges of said tape-cutting means to slide past each other to thereby cut said tape material to a cut-off piece having a predetermined length; and causing a pair of end-trimming edges of said end-trimming means to slide past each other to thereby trim an end of said cut-off piece into a predetermined shape.

29. A cutting device for cutting tape material, comprising:

a tape-cutting block for cutting off said tape material, said tape-cutting block having a pair of tape-cutting edges which slide past each other to thereby cut said tape material to a cut-off piece having a predetermined length, said tape-cutting block having at least one movable blade formed with one of said pair of tape-cutting edges;

an end-trimming block for trimming an end of said cut-off piece, said end-trimming block having a pair of end-trimming edges which slide past each other to thereby trim said end of said cut-off piece into a predetermined shape, said end-trimming block having at least one movable blade formed with one of said pair of end-trimming edges; and a cutting operation block provided as a single component for causing said at least one movable blade of said tape-cutting block and said at least one movable blade of said end-trimming block to perform cutting operations, respectively.

30. A printing apparatus, comprising:

a cutting device for cutting a tape material, said cutting device including a tape-cutting block for cutting off tape material, said tape-cutting block having a pair of tape-cutting edges which slide past each other to thereby cut said tape material to a cut-off piece having a predetermined length, an end-trimming block for trimming an end of said cut-off piece, said end-trimming block having a pair of end-trimming edges which slide past each other to thereby trim said end of said cut-off piece into a predetermined shape, and a cutting operation block provided as a single component for causing said tape-cutting block and said end-trimming block to perform cutting operations, respectively;

a printing block for printing a portion of said tape material as desired; and a tape-feeding mechanism for feeding said tape material to bring said tape material to said cutting device.

* * * * *

UNITED STATES PATENT AND TRADEMARK OFFICE

CERTIFICATE OF CORRECTION

PATENT NO. : 5,823,694

DATED : October 20, 1998

INVENTOR(S) : Toshimasa Ikegami

It is certified that error appears in the above-identified patent and that said Letters Patent is hereby corrected as shown below:

Claim 24, first line, please change "23" to --22--.

Claim 25, first line, please change "23" to --22--.

Signed and Sealed this

Fourth Day of May, 1999

*Attest:*

*Attesting Officer*

Q. TODD DICKINSON

*Acting Commissioner of Patents and Trademarks*